United States Patent [19]

Storey

[11] 4,065,867

[45] Jan. 3, 1978

[54] LOCK FOR RIFLE

[76] Inventor: Dale A. Storey, 1764 S. Wilson, Casper, Wyo. 82601

[21] Appl. No.: 747,776

[22] Filed: Dec. 6, 1976

[51] Int. Cl.[2] ..... F41C 19/00

[52] U.S. Cl. ..... 42/69 R; 42/51

[58] Field of Search ..... 42/69 R, 51, 83

[56] References Cited

U.S. PATENT DOCUMENTS

| | | | |
|---|---|---|---|
| 20,757 | 6/1858 | Brey | 42/69 R |
| 28,677 | 6/1860 | Lord | 42/83 |
| 150,349 | 4/1874 | Nudd | 42/69 R |
| 1,226,443 | 5/1917 | Baker | 42/51 |
| 3,577,667 | 5/1971 | Kern | 42/51 |

*Primary Examiner*—Charles T. Jordan

*Attorney, Agent, or Firm*—Warren F. B. Lindsley

[57] ABSTRACT

An improved lock for a muzzle-loading caplock rifle, the lock producing a side-hammer action with a vertically acting sear in a design utilizing only coil springs and a minimum number of simple parts.

6 Claims, 9 Drawing Figures

LOCK FOR RIFLE

BACKGROUND OF THE INVENTION

Black-powder shooting using the once popular muzzle-loading caplock rifle had almost completely died out in the period of 1940's and 1950's as the simple elegance and utility of this highly effective firearm was replaced by more modern weapons which were easier to load and permitted more rapid firing. Beginning in the late 1950's and throughout the 1960's, however, there began to develop a new interest in the sheer sport of hunting as opposed to the desire simply to bag large quantities of game. Hunting with the bow and arrow rose in popularity because it presented a greater challenge to the hunter. At the same time, there was a renewed interest in the older and simpler firearms as opposed to the modern weapons which had become so overwhelming against small game that there was little sport left in hunting.

The renewed interest in black-powder shooting which was a part of this trend produced a particularly strong revival of the old muzzle-loading caplock rifle to the point that during the past five or six years both the firearm and replacement parts have become readily available. High-quality versions of this old firearm are being produced in elegant replicas of past designs.

Because the original models were designed and produced prior to the introduction of modern manufacturing methods and techniques, however, certain features of the old designs should preferably be improved in the interest of safety, reliability and a long operating life. The need for such improvement is particularly acute in connection with the hammer-lock mechanism.

The older locks utilized flat springs that are difficult to manufacture and which soon lose their original characteristics through fatigue or hard use. Adjustments of the mechanisms were difficult and usually required the filing or grinding away of metal to achieve the desired trigger sensitivity. Very often, the sensitivity of the lock was realized to the detriment of safety. Furthermore, the older designs are expensive to manufacture and there is a high potential for reducing cost through the development of new designs which better lend themselves to modern methods of manufacturing.

SUMMARY OF THE INVENTION

In accordance with the invention claimed, a new and improved gun lock is provided with particular application to black-powder firearms.

It is, therefore, one object of this invention to provide an improved lock for a muzzle-loading caplock rifle.

Another object of this invention is to provide such a lock in a form which incorporates only coil springs rather than the usual flat springs which are less reliable, have a shorter operating life and are more expensive to manufacture.

A further object of this invention is to provide such an improved lock which is more easily and controllably adjustable using only a screwdriver as a tool with no filing or grinding of parts required.

A still further object of this invention is to provide such an improved lock in a form which utilizes a vertically acting sear so that standard and readily available triggers may be employed therewith.

A still further object of this invention is to provide such an improved lock while utilizing a side-hammer action, thereby to afford the ignited gasses from the percussion cap a more direct route into the powder chamber.

A still further object of this invention is to provide such an improved lock mechanism which is readily adaptable to firearms of types other than the muzzle-loading caplock rifle.

A still further object of this invention is to provide in such an improved lock mechanism a positive and dependable locking action which will result in a maximum level of safety and reliability.

Yet another object of this invention is to provide such an improved lock in a form utilizing a minimum number of inexpensive parts so that its manufacturing cost will be inherently low and its operating life correspondingly long.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
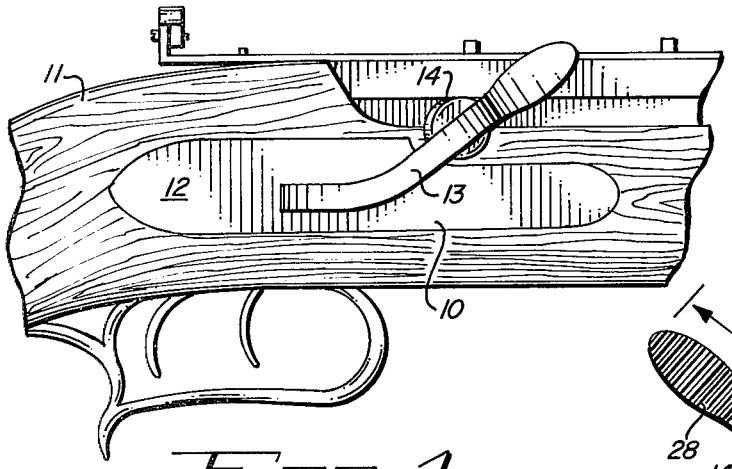
FIG.1 is a perspective side view of the improved lock of the invention as installed in a muzzle-loading caplock rifle.

Referring more particularly to the drawing by characters of reference, FIG. 1 shows an improved lock 10 embodying the invention installed in a muzzle-loading caplock rifle 11. The visible parts of the lock 10 as seen in FIG. 1 are its lock plate 12 and hammer 13. The hammer 13 is shown in its fired or released position with its nose 14 covering and obscuring the percussion nipple of the rifle.

Figure 2:
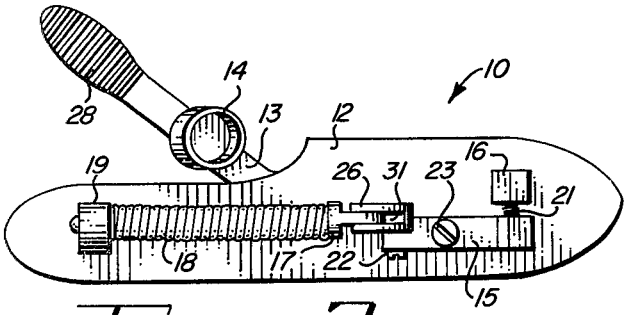
FIG. 2 is a perspective view of the lock itself as seen from the rear.
Figure 3:
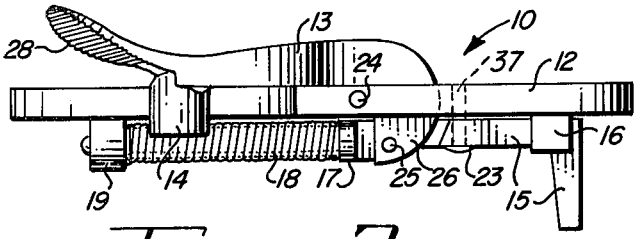
FIG. 3 is a perspective side view of the lock with the hammer released.
Figure 4:
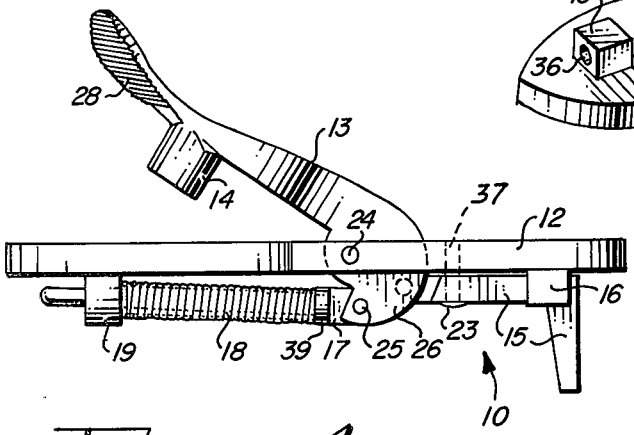
FIG. 4 is a perspective side view of the lock shown in the cocked position.

FIGS. 2, 3 and 4 show in greater detail the total structure of lock 10 which comprises, in addition to plate 12 and hammer 13, a sear 15, sear stud 16, hammer strut 17, hammer spring 18, hammer stud 19, sear spring 21, sear engagement screw 22, sear pivot screw 23, hammer pivot pin 24, and a hammer strut pin 25.

Figure 6:
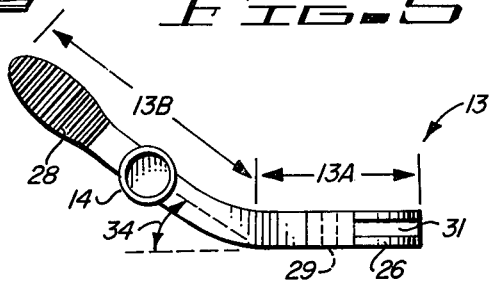
FIG. 6 is an edge view of the special hammer utilized in the lock.

Hammer 13 has a first portion 13A and a second portion 13B as shown in FIG. 6. The first portion 13A has a split semicircular projection 26 at its outer end which is formed and drilled to accommodate the pivotal support of hammer 13 within an opening 27 in plate 12 and to provide for the support of hammer strut 17, while the second portion 13B has a tapered finger grip 28 at its extremity and carries the hammer nose 14 at its center. Nose 14 and projection 26 are both inwardly extending from the body of hammer 13 as considered relative to the mounting orientation of lock 10 on the side of rifle 11 as shown in FIG. 1.

The nose 14 is cup-shaped and its closed end is welded or brazed to the slender body of portion 13B of hammer 13. Alternatively, nose 14 may be cast or formed integrally with the main body of hammer 13.

Figure 6A:
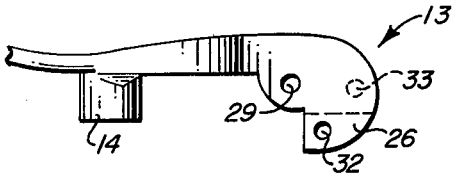
FIG. 6A is a partial side view of the hammer of FIG. 6.

As shown in FIG. 6A, the profile of projection 26 and of the outboard end of portion 13A is roughly circular about a hole 29 through which the hammer pivot pin is passed when hammer 13 is mounted in opening 27 of plate 12. From this generally circular profile the inboard quadrant of the otherwise circular projection is removed, leaving a web around hole 29 and leaving the semicircular projection 26. Projection 26 has a longitudinal slot 31 which serves as a clevis for the support of hammer strut 17. A transverse hole 32 through the slotted end of extension 26 carries strut pin 25. Another hole 33, drilled into one side of end 13A near its outboard end, serves as a catch for the end of sear engagement screw 22.

When hammer 13 is viewed from its inboard side relative to its mounting orientation with respect to rifle 11 and as seen in FIG. 6, portions 13A and 13B are seen to be inclined relative to each other such that the longitudinal axis of portion 13B departs from the longitudinal axis of portion 13A by an angle 34 of approximately thirty to sixty degrees. As will be clarified later, this inclination of portion 13B relative to portion 13A permits nose 14 to clear the edge of plate 12 during the firing stroke of lock 10.

Figure 7:
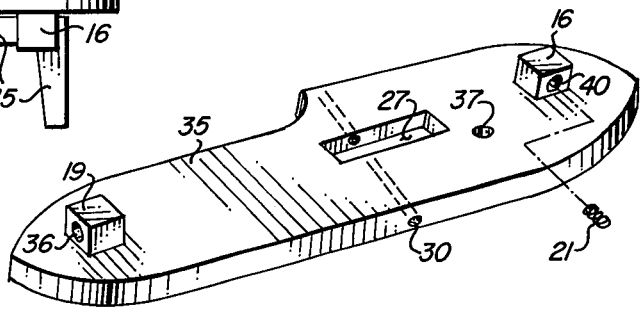
FIG. 7 is a perspective view of the lock plate.

As shown most clearly in FIG. 7, lock plate 12 is cut from a flat plate in the general shape of a long, narrow oval with an arcuate sector 35 removed from one quadrant. The arcuate sector 35 is removed to clear the percussion nipple, which is located just above plate 12 on the side of rifle 11 and which leads directly into the powder chamber at the breech end of the barrel of the rifle. The opening 27 is rectangular and is located near the center of plate 12, its longer dimension aligned with the longitudinal axis of the generally oval outline of plate 12.

The hammer stud 19 is a generally rectangular block projecting from one face of plate 12 near the end that is reduced by the arcuate sector 35. A hole 36 passing through stud 19 and aligned with the longitudinal axis of plate 12 carries the end of strut 17. A hole 30 passes edgewise through plate 12, intersecting opening 27 near the end closest to stud 19. Hole 30 is employed to hold hammer pivot pin 24.

The sear stud 16 is also a generally rectangular projection extending from the same face of plate 12 near the end opposite hammer stud 19. A blind hole 40 is drilled into the side of stud 16 to serve as a containing chamber for sear spring 21.

A drilled and tapped hole 37 through plate 12 and located between stud 16 and opening 27 is provided to accept the sear pivot screw 23.

Figure 8:
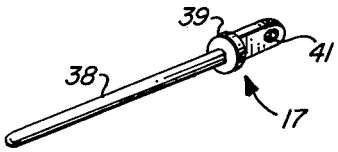
FIG. 8 is a perspective view of the hammer strut utilized in the lock of the invention.

Hammer strut 17, as shown most clearly in FIG. 8, comprises a long slender rod 38 attached at one end to a head 39 which is flattened and pierced by a hole 41 to receive the hammer strut pin 25.

Figure 5:
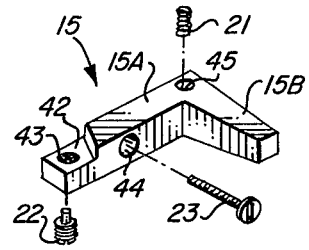
FIG. 5 is a perspective view of the special sear utilized in the lock.

Sear 15, as shown more clearly in FIG. 5, is an L-shaped member comprising a base 15A and a laterally extending portion 15B. Base 15A is rectangular in cross-section having one corner 42 cut back to provide clearance for the end of hammer 13. Portion 15B of sear 15 is also rectangular in cross-section and tapers to a reduced cross-sectional configuration at its upper end. A transverse hole 43 through the reduced end of base 15A is tapped to receive sear engagement screw 22. A hole 44 through the center of base 15A having its axis aligned with portion 15B, provides clearance for pivot screw 23. A blind hole 45 is drilled into one side of sear 15 near the corner where base 15A adjoins portion 15B. Hole 45 is provided to contain one end of sear spring 21.

To assemble lock 10, projection 26 of hammer 13 is first inserted through opening 27 of plate 12 from the side opposite studs 16 and 19 with grip 28 extending in the direction of the narrow end of plate 12. Hole 29 of hammer 13 is then aligned with hole 30 of plate 12 and pin 24 is passed through holes 29 and 30 where it is secured by an interference fit inside hole 30. Clearance between pin 24 and hole 29 permits the free rotation of hammer 13 about pin 24.

Spring 18 is then slipped over rod 38 of strut 17, the end of rod 38 is inserted through hole 36 of stud 19, and the flattened end of head 39 is positioned inside slot 31 of projection 26 at the end of hammer 13. With hole 41 of strut 17 aligned with hole 32 of hammer 13 pin 25 is inserted therethrough. Pin 25 fits with interference in hole 32 and with clearance for rotation through hole 41.

Finally, the sear is pivotally secured to plate 12 by means of pivot screw 23 which passes with clearance through hole 44 of sear 15 and threads into hole 37 of plate 12.

As sear 15 is positioned to be secured in the above manner, the sear spring is placed with one end inside hole 45 of sear 15 and with the other end inside hole 40 of stud 16. Projection 26 of hammer 13 sufficiently limits the rotation of sear 15 about screw 23 to sustain the confinement of spring 21 within blind holes 40 and 45.

As hammer 13 is rotated about pin 24, the hole 33 strikes an arc which intersects hole 43 at the end of sear 15. This end of sear 15 is also forced against the adjacent surface of projection 26 as it moves by, such forcing action being provided by sear spring 21 which is a simple coil spring held in compression within holes 40 and 45. It is thus apparent that when sear engagement screw 12 is threaded into hole 43 of sear 15 so that its tip protrudes through the surface bearing against projection 26, the protruding tip will drop into hole 33 when alignment is achieved. When this occurs, the lock 10 is in the cocked position.

It will be appreciated and understood through an examination of FIGS. 3 and 4 that as grip 28 at the free end of hammer 13 is raised from the uncocked position of FIG. 3 toward the cocked position of FIG. 4, pin 25 at the tip of projection 26 is rotated leftward carrying with it the head 39 of strut 17 and compressing spring 18 between head 39 and stud 19. When the cocked position is reached and the tip of screw 22 engages hole 33 of hammer 13, the locking action occurs and the potential energy of compressed spring 18 is set for the firing action.

The firing action is initiated by rotating sear 15 in a counter-clockwise direction about screw 23 as viewed in FIG. 2. The counter-clockwise rotation against spring 21 causes the tip of screw 22 to be withdrawn from hole 33 of hammer 13. When this occurs, spring 18 is released abruptly and its expansion produces a rapid counter-clockwise rotation of hammer 13 about pin 24 as viewed in FIGS. 3 and 4 so that nose 14 drops sharply from its upwardly extended position of FIG. 4 to its lowered position of FIG. 3. When lock 10 is mounted on rifle 11, the rotation of sear 15 is produced by the action of a vertically moving trigger against portion 15B of sear 15, and nose 14 of hammer 13 falls sharply against the percussion nipple.

By virtue of the inclination of portion 13B relative to portion 13A of hammer 13, the main body of lock assembly 10 may be aligned with the available opening within rifle 11 adjacent the breech end of the barrel while at the same time affording access of hammer nose 14 to the percussion cap which is located directly above lock 10 where it leads directly into the powder chamber. By virtue of such direct access to the powder chamber, a maximum degree of firing efficiency is achieved.

It will now be recognized that lock 10 is also responsive to the other stated objects of the invention. Two simple coil springs, 18 and 21, are utilized to the exclusion of any other type of spring. Coil springs of this type are inexpensive, they are readily available, and they operate reliably over long periods of time. The sensitivity of lock 10 is readily and controllably adjustable by means of sear engagement screw 22. The side hammer action affored through the special design of hammer 13 and the cooperating parts of lock 10 is achieved in a simple and inexpensive manner utilizing only a few parts and incorporating a vertically activated sear to permit the use of a standard trigger. While lock 10 is described with reference to its application in a muzzle-loading caplock rifle, it will be apparent that with minor modifications, it may be applied as well to firearms of other types, and although but a single embodiment has been illustrated and described, it will be apparent to those skilled in the art that various changes and modifications may be made therein without departing from the spirit of the invention or from the scope of the appended claims.

What is claimed is:

1. A lock for mounting on a muzzle-loading caplock weapon comprising in combination:

a lock plate having an opening extending therethrough, a hammer pivotally mounted on said plate and arranged to move laterally to and from one plane surface thereof, one end of said hammer comprising a projection extending through said opening in said plate for engaging with a sear mounted on the other plane surface of said plate, the other end of said hammer being provided with a nose selectively engagable with a percussion cap mounted on a nipple on the weapon, spring means mounted on said other plane surface of said plate and arranged to extend between a fixed point on said plate and said one end of said hammer whereby a given pivotal movement of said hammer compresses said spring means, a sear pivotally mounted on said other plane surface of said plate and biased into engagement with said projection of said hammer, and lock means mounted on said sear for detachably engaging said projection of said hammer when said hammer is moved laterally away from said one plate surface of said plate, said lock means comprising a bolt threadably mounted to extend through said sear and engageable with an indentation in said protrusion of said hammer to detachably engage therewith, whereby a trigger of the weapon when actuated engages said sear, dislodging said lock means of said sear from said protrusion causing said spring means to rotate said one end of said hammer toward said plate causing said nose to engage the percussion cap on the nipple of the weapon.

2. The lock set forth in claim 1 wherein:

said spring means comprises a coil spring mounted on said plate to extend longitudinally thereof between said point on said plate and said one end of said hammer.

3. The lock set forth in claim 2 wherein:

said sear is pivotally mounted to move substantially parallel with said other plane surface into engagement with said projection of said hammer.

4. The lock set forth in claim 2 wherein:

one part of said sear is biased into engagement with said hammer by a coil spring extending between another part of said sear and said hammer.

5. The lock set forth in claim 1 wherein:

said spring means comprises a coil spring mounted around a rod, one end of said rod being slidably mounted in a hole formed in a stud extending laterally from said other plane surface of said plate, and the other end of said rod being pivotally attached to said protrusion, whereby said coil spring biases said percussion cap and said hammer toward said plate.

6. The lock set forth in claim 1 wherein:

the pivotal mounting of said sear on said plate comprises a threadable connection, the position of which determines the trigger force of the weapon needed to actuate said hammer.

* * * * *

UNITED STATES PATENT OFFICE

CERTIFICATE OF CORRECTION

Patent No. 4,065,867 Dated January 3, 1978

Inventor(s) Dale A. Storey

It is certified that error appears in the above-identified patent and that said Letters Patent are hereby corrected as shown below:

Claim 1, second column, line 15, cancel "plate", first occurrence, and substitute ---plane---.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*